US006656054B2

(12) United States Patent
Ulrich

(10) Patent No.: US 6,656,054 B2
(45) Date of Patent: Dec. 2, 2003

(54) GOLF GRIP WITH HAND PLACEMENT GUIDE

(75) Inventor: James J. Ulrich, Laurinburg, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/137,232

(22) Filed: May 2, 2002

(65) Prior Publication Data

US 2003/0207717 A1 Nov. 6, 2003

(51) Int. Cl.[7] ..... A63B 69/36
(52) U.S. Cl. ..... 473/201; 473/300; 473/549
(58) Field of Search ..... 473/201, 206, 473/203, 204, 219, 226, 300, 549

(56) References Cited

U.S. PATENT DOCUMENTS

| | | | | | |
|---|---|---|---|---|---|
| 1,556,473 | A | * | 10/1925 | Ballou | 473/203 |
| 1,587,082 | A | * | 6/1926 | Mattern | 473/201 |
| 2,468,202 | A | * | 4/1949 | Karns | 473/300 |
| 2,690,338 | A | * | 9/1954 | De Brocke | 473/203 |
| 3,366,384 | A | * | 1/1968 | Lamkin et al. | 473/300 |
| 3,806,130 | A | * | 4/1974 | Jacques | 473/206 |
| D243,355 | S | * | 2/1977 | Spencer | D21/756 |
| 4,065,127 | A | | 12/1977 | Fagan | 273/81 D |
| D281,991 | S | * | 12/1985 | Solheim | D21/756 |
| D284,298 | S | * | 6/1986 | Kobayashi | D21/756 |
| 4,919,420 | A | | 4/1990 | Sato | 273/81 B |
| 4,974,846 | A | | 12/1990 | Fenton | 273/81 B |
| D315,006 | S | * | 2/1991 | Solheim | D21/756 |
| D336,322 | S | * | 6/1993 | Poincenot et al. | D21/756 |
| 5,348,303 | A | * | 9/1994 | Swissheim | 473/201 |
| 5,419,031 | A | * | 5/1995 | McLendon | 29/450 |
| 5,427,376 | A | * | 6/1995 | Cummings et al. | 473/201 |
| 5,480,146 | A | | 1/1996 | Comer | 273/81.4 |
| 5,570,884 | A | | 11/1996 | Carps | 473/298 |
| 5,611,533 | A | * | 3/1997 | Williams | 473/568 |
| 5,686,158 | A | * | 11/1997 | Gibbon | 428/36.92 |
| 5,762,563 | A | | 6/1998 | Holzhausen | 473/206 |
| 5,906,548 | A | * | 5/1999 | Hadge | 473/206 |
| 6,022,278 | A | * | 2/2000 | Vela | 473/201 |
| 6,152,831 | A | | 11/2000 | Arcenas | 473/206 |
| 6,210,289 | B1 | | 4/2001 | LaBrake | 473/201 |

* cited by examiner

*Primary Examiner*—Sebastiano Passaniti
*Assistant Examiner*—Nini F. Legesse
(74) *Attorney, Agent, or Firm*—Daniel S. Kalka

(57) ABSTRACT

A golf club grip (10) with an integral hand placement indicator (20) for encouraging hand placement using a plurality of opposed arcs (32, 32') for a traditional three knuckle power position which assists in squaring the club face (17) with a golf ball upon impact. The predetermined sinuous surface pattern (20) provides at least a first pair of opposed arcs (34, 34'), a second pair of opposed arcs (36, 36') and a third pair of opposed arcs (38, 38') with the second pair (36, 36') and the third pair (38, 38') being preferably indicative of a first hand position (40) and a second hand position (42).

14 Claims, 4 Drawing Sheets

GOLF GRIP WITH HAND PLACEMENT GUIDE

BACKGROUND OF THE INVENTION

1. Field of the Invention

The present invention relates in general to a golf grip, and more specifically to a golf grip having an integral hand placement guide thereon.

2. Description of the Related Art

Hand placement or hand grip on a golf club grip is an important factor in a golf swing for influencing the distance and direction of the golf ball. Proper hand placement allows the golf club swing to be properly executed in a consistent manner which drives the golf ball in a fairly predictable fashion.

There are many items being offered today as teaching aids for the golfer to guide the golfer's hands into proper alignment. Many of these devices are external devices that attach to or slip over the grip, such as the tongue shaped lever disclosed in U.S. Pat. No. 6,142,831 which is placed on the grip end, or the rib guide that wraps around the surface of the golf club grip described in U.S. Pat. No. 6,210,289.

Another approach to proper hand positioning is the use of separate recesses for the fingers formed in the golf club grip as disclosed in U.S. Pat. No. 5,480,146.

While these teaching aids may be useful for golf beginners, golfers who have played the game for some time also take into account appearance and "regulation play", that is, what is allowed in a golf tournament or a certain golf course according to set rules.

Moreover, the prior art devices tend to align the hands in what is termed the "neutral position". In this hand position, one hand grips the golf club grip and the other hand (top hand) clasps the grip slightly overlapping the first hand in a position where the thumb of the top hand points down the center of the grip towards the golf club head. This neutral position can cause a golfer to strike the golf ball in a way that prevents square contact with the face of the golf club head. This results in a weaker shot in that the ball does not travel as far as it could have if there had been square contact. In addition, the golf ball may veer away or hook either to the right or left of the intended target.

Thus, there is still a need for a golf club grip with an integral hand placement guide that allows for proper hand placement preferably in what is known as the traditional three-knuckle power or strong position, also referred to herein as simply the power or strong position. In this position, the thumb of the top hand is across the center of the golf club grip slightly to one side of the grip. Three knuckles of the top hand are usually visible to the golfer. This hand position facilitates a golf swing that strikes the golf ball squarely with the face of the golf club resulting in a straighter shot with more distance.

BRIEF SUMMARY OF THE INVENTION

Accordingly, an object of the present invention is to provide a golf club grip with an integral hand placement indicator.

Another object of the present invention is to provide a golf club grip with visual guidance for hand placement in a strong position.

Still another object of the present invention is to provide a golf club grip with a pleasant appearance that also functions as a guide for proper hand placement.

Still another object of the present invention is to provide a slip-on golf club grip that has a distinctive and pleasant appearance as well as the convenience, economy, and reliability of a one-piece, slip-on molded rubber golf club grip.

Still another object of the present invention is to provide a method for hand placement on a golf club grip that encourages use of the power position.

The above and other objects of the present invention are accomplished with a golf club grip with an integral hand placement indicator comprising an elastomeric body having a generally cylindrical shape. The elastomeric body further includes a bore constructed to be slidably received on a golf club shaft. A predetermined sinuous surface pattern is provided on at least the front side of the elastomeric body. The predetermined sinuous surface pattern extends from an upper region of the elastomeric body to a lower region. The predetermined sinuous surface pattern is constructed to indicate hand placement for a power position on the golf club grip.

Another aspect of the present invention is directed to a method for hand placement on a golf club grip, comprising the steps of: providing an elastomeric body having a generally cylindrical shape with a bore to be slidably received on a golf club shaft, forming a predetermined sinuous surface pattern on at least a front side of the elastomeric body, the predetermined sinuous surface pattern extending from an upper region of the elastomeric body to the lower region thereof, and indicating hand placement on the elastomeric body with the predetermined sinuous surface pattern.

The various features of novelty which characterize the invention are pointed out with particularity in the claims annexed to and forming a part of this disclosure. For a better understanding of the invention, its operating advantages, and specific objects attained by its uses, reference is made to the accompanying drawings, and descriptive matter in which a preferred embodiment of the invention is illustrated.

DETAILED DESCRIPTION OF THE INVENTION

Figure 1:
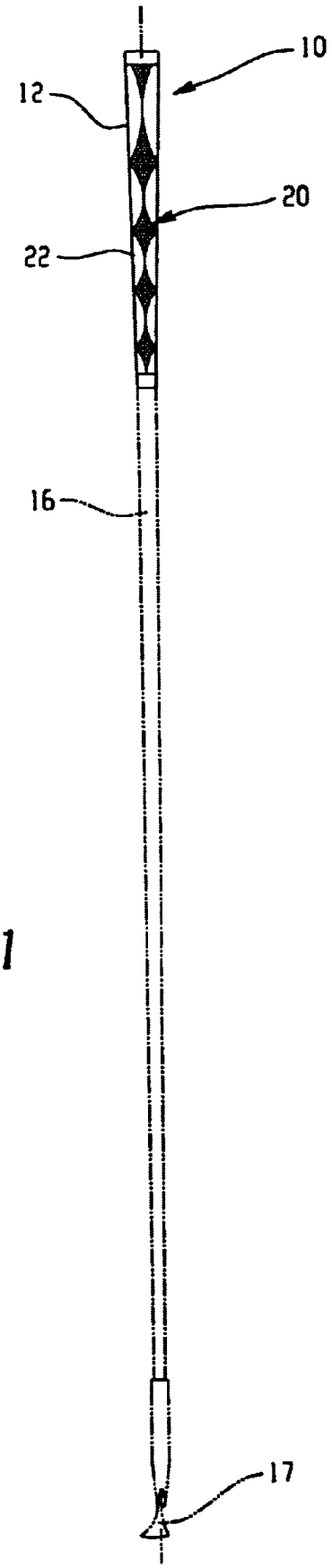
FIG. 1 is a front view of a golf club with a golf club grip in accordance with the present invention.

Referring to the figures, which are not intended to limit the present invention thereto, and where like numerals designate like or similar features throughout the several views, and first in particular to FIG. 1 there is shown a golf club grip generally designated 10 in accordance with the present invention. Golf club grip 10 is preferably a slip-on golf club grip. The term "slip-on" as employed herein is intended to refer to a golf club grip that is designed to slide onto a golf club shaft or handle and be secured thereto by an adhesive, tape, or combination thereof. Slip-on golf club grips are available in many shapes and forms, and are widely used in the industry. The manner in which they are made and held in place on a golf club shaft is also well known. These types of grips may even be considered "conventional golf club grips". Typically, slip-on golf club grips are made of an elastomeric material like a rubber compound or a synthetic plastic and can contain fibers or cords embedded therein. These styles of grips usually have some of the rubber compound buffed to leave some cord on the surface to provide more grip in wet weather or due to hand perspiration.

The terms "elastomer", "rubber compound", "synthetic plastic", "thermoplastic", "thermoset material", or simply "rubber" are used herein interchangeably and are intended to refer to the same type of material. There are many rubber compounds known in the industry used for molding a wide variety of slip-on golf club grips. These materials offer convenience, economy, and durability as well as providing a good hand feel or grip. The rubber material is easy on the hands and provides a good grip in all types of weather and playing conditions.

Figure 3:
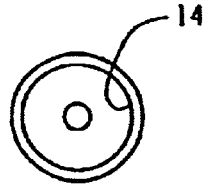
FIG. 3 is a bottom plan view of the golf club grip.
Figure 4:
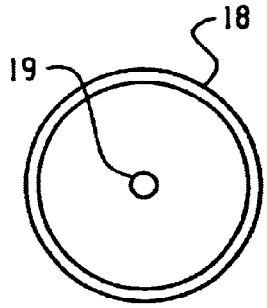
FIG. 4 is a top plan view of the golf club grip.

In FIG. 1, golf club grip 10 in accordance with the present invention comprises an elastomeric body 12 having a generally cylindrical shape. The elastomeric body 12 includes a bore 14 seen in FIG. 3 which is constructed to be slidably received on a golf club shaft 16. Grip 10 further includes preferably an end cap 18 with aperture 19 integrally molded thereon. Golf club grip 10 is preferably tapered to a similar shape as golf club shaft 16 as depicted in the bottom and top plan views of FIGS. 3 and 4, respectively. As mentioned previously, golf club grip 10 is secured on golf shaft 16 as is known in the industry with an adhesive.

Elastomeric body 12 includes a predetermined sinuous surface pattern 20 on at least the front side 22 of grip 10. The term "front side" as employed herein is intended to refer to the side of the golf grip 10 a golfer would see looking down on the grip when the golfer is preparing to swing the golf club. The predetermined sinuous surface pattern 20 is in substantial axial alignment with the golf club shaft 16 and the golf club face 17. The opposite side or back side of grip 10 may have any ornamental pattern, if desired, or none at all. The opposite side of grip 10 may even include the predetermined sinuous surface pattern identical to the front side 22.

Figure 2:
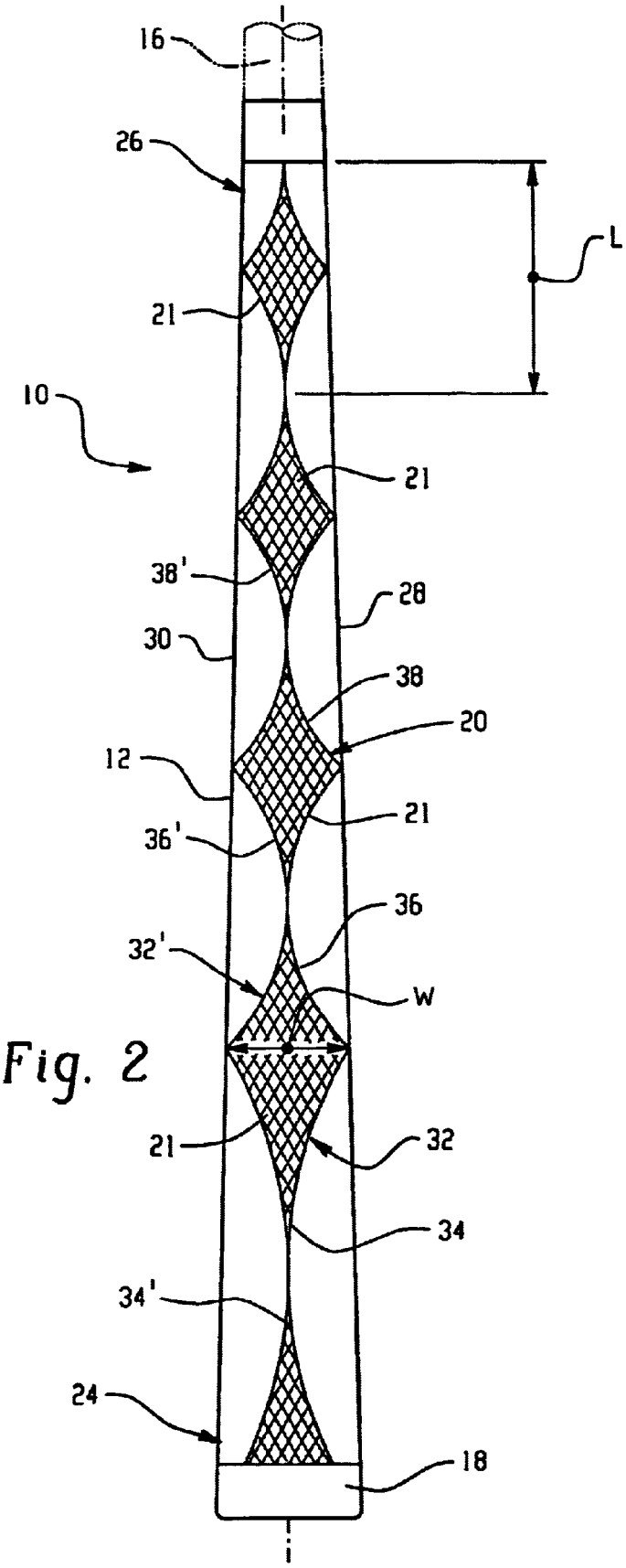
FIG. 2 is a front elevational view of the golf club grip in accordance with the present invention.

Turning next to FIG. 2, the predetermined sinuous surface pattern 20 extends from an upper portion 24 of grip 10 to a lower portion 26, and essentially divides the front side 22 of the golf grip 10 into two halves 28, 30. The terms "upper" and "lower" as used herein are meant to refer to portions of elastomeric body 12 as situated on the golf shaft as seen in FIG. 1. The upper portion 24 of body 12 is closest to the end of the golf shaft 16, and the lower portion 26 of body 12 is closest to the club face 17.

The two halves 28, 30 are also referred to herein as a "right" half or side, and a "left" half or side. The terms "right" and "left" refer to the golf grip 10 as the golfer views the grip looking down on it.

The predetermined sinuous surface pattern 20 forms a plurality of opposed arcs generally designated 32, 32'. The plurality of opposed arcs generally designated 32, 32' form at least a first pair of opposed arcs 34, 34', a second pair of opposed arcs 36, 36', and a third pair of opposed arcs 38, 38'. The pairs of opposed arcs 32, 32' in accordance with the present invention are indicative of proper hand placement for the power position as will be described herein in more detail later. As seen in FIG. 2, the arcs 32, 32' are formed by the predetermined sinuous surface pattern on each half 28, 30 on the front side 22 of grip 10. Surface pattern 20 may be molded into grip 10 as a depression or groove and then painted, or surface pattern 20 may be simply painted thereon. The preferred color for surface pattern 20 is gold, but any color may be used with the present invention.

The predetermined sinuous surface pattern 20, may also be described as being a series of diamond shapes 21 that progressively increase in size from the lower portion 26 to the upper portion 24 of elastomeric body 12 eventually terminating with an incomplete diamond shape. The length (L) of a diamond shape 21 is selected to provide an arrangement on the grip 10 that has at least three opposed pairs of arcs 32, 32', and preferably four pairs. The width (W) of each diamond shape 21 extends substantially across the front side 22 of grip 10. Even though the surface pattern 20 is shown with a crosshatching pattern inside the diamond shape 21, as seen in FIG. 2, it should be understood that any ornamental pattern, or even no pattern at all, may be placed inside the diamond shapes 21.

Figure 5:
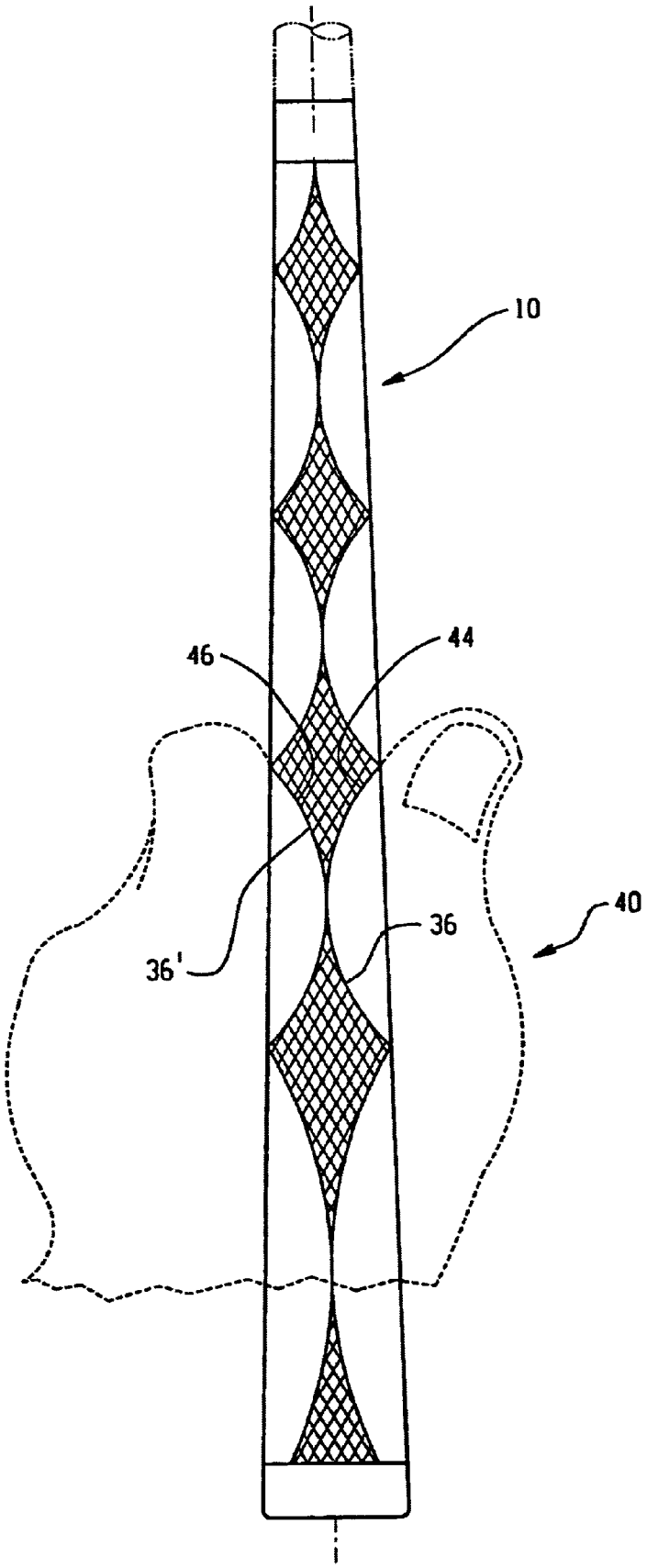
FIG. 5 is a front elevational view of the golf club grip in accordance with the present invention showing the first hand position.
Figure 6:
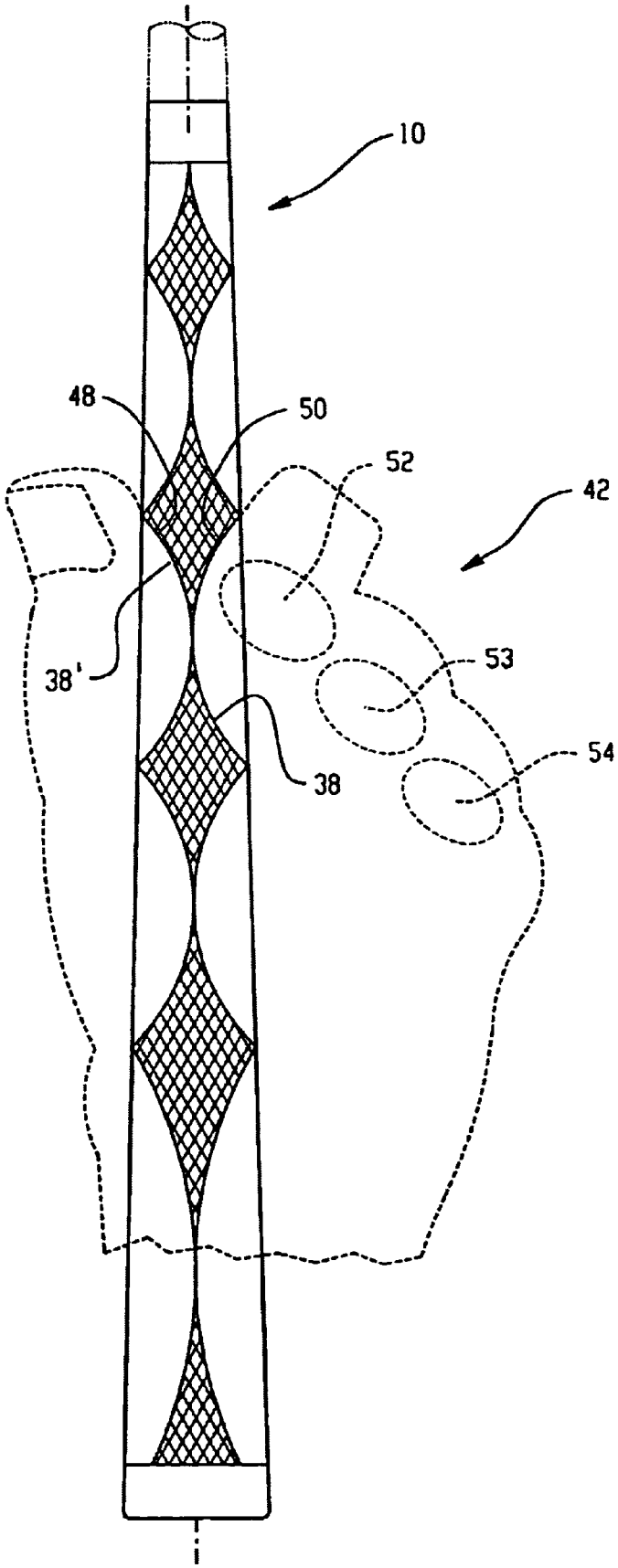
FIG. 6 is a front elevational view of the golf club grip in accordance with the present invention showing the second hand position.

Another aspect of the present invention is directed to a method for using the golf grip 10 with integral hand placement indicator. Referring now to FIGS. 5 and 6, there are shown the first hand and second hand positions 40, 42 on the golf club grip 10 in accordance with the method of the present invention. The first hand position may also be referred to as the "bottom" hand position; and the second hand position may also be referred to as the "top" hand position. These hand positions 40, 42 are illustrative for a right-handed golfer. The hand position would simply be opposite for a left-handed golfer. The first hand position 40 includes placing an inner edge of thumb 44 along the curvature of arc 36 and an inner edge of the index finger 46 along the curvature of the opposed arc 36' while grasping the golf club grip 10 firmly with the fingers of the hand. Even though FIG. 5 depicts three knuckles shown on the bottom hand, it must be understood that the number of knuckles shown refers to the knuckles of the top hand as seen in FIG. 6.

In the second hand position 42, the inner edge of thumb 48 is aligned with the curvature of arc 38' and the inner edge of the index finger 50 is aligned with the curvature of arc 38. The hand then firmly grasps the golf club grip 10 in an orientation where the second hand 42 is slightly on top of and overlaps the first hand 40 with both hands firmly grasping the golf club grip 10. If desired, the golfer may interlock one or more fingers between the hands. As seen in FIG. 6, the first 52, the second 53, and third knuckles 54 of the hand are positioned in a manner that helps place the golf club face 17 square with the golf ball during a golf swing. It should be understood that the term "three knuckle power position" simply means that often three knuckles of the hand are shown as in FIG. 6, but it is possible to properly position the hand in the power position with only one or two knuckles shown. In this manner, golf club grip 10 in accordance with the present invention has provided a visual indicator to the golfer for proper hand placement in the three-knuckle power or strong position. For the left handed golfer, the right hand would be placed in the first hand position 40 and the left hand in the second hand position 42.

In accordance with another aspect of the present invention, there is provided a method for hand placement on a golf club grip 10, comprising the steps of: providing an elastomeric body 12 having a generally cylindrical shape with a bore 14 to be slidably received on a golf club shaft 16, forming a predetermined sinuous surface pattern 20 on at least a front side 22 of the elastomeric body 12, the predetermined sinuous surface pattern 20 extending from an upper region 24 of the body 12 to a lower region 26 thereof, and indicating hand placement 40, 42 on the body 12 with the predetermined sinuous surface pattern 20. The method further includes utilizing a selected plurality of opposed arcs 36, 36', 38, 38' for indicating first hand position 40 and the second hand position 42.

It should be further apparent that slight modifications may be made to the method of the present invention. As an example, a right handed golfer may choose to simply grasp the upper portion 24 of the golf grip 10 with his left hand in a manner where the thumb is placed substantially on the center of the grip similar to the neutral position. Then, the right hand is placed in the second hand position 42. A left handed golfer could do likewise by simply reversing hands.

Furthermore, the golf club grip 10 according to the present invention will allow the golfer to use the neutral position for hand placement, if desired. The diamond shapes 21 assist in thumb alignment on the center of the grip 10.

While specific embodiments of the invention have been shown and described in detail to illustrate the application of the principles of the invention, it will be understood that the invention may be embodied otherwise without departing from such principles.

I claim:

1. A golf club grip (10) with an integral hand placement indicator, comprising:

an elastomeric body (12) having a generally cylindrical shape, said elastomeric body (12) further having a bore (14) constructed to be slidably received on a golf club shaft (16); and a predetermined sinuous surface pattern (20) on at least a front side (22) of said elastomeric body (12), said predetermined sinuous surface pattern comprises a plurality of contiguous pairs of opposed arcs (32, 32') situated radially lengthwise along the golf club grip (10), said predetermined sinuous surface pattern (20) extending from an upper portion of said body (24) to a lower portion (26) thereof, said predetermined sinuous surface pattern (20) being constructed for indicating hand placement on the golf club grip.

2. A golf club grip (10) according to claim 1, wherein said predetermined sinuous surface pattern (20) comprises a series of diamond shapes (21) positioned on the front side (22) of said golf club grip (10), each of said diamond shapes having a width (w) extending radially across one side of said golf club grip.

3. A golf club grip (10) according to claim 2, wherein said series of diamond shapes (21) progressively increase in size beginning at the lower portion (26) and extending to the upper portion (24) of the golf club grip (10).

4. A golf club grip (10) according to claim 2, wherein said predetermined sinuous surface pattern (20) is painted on the golf club grip (10).

5. A golf club grip (10) according to claim 4, wherein said predetermined sinuous surface pattern (20) further comprises a depression molded into the golf club grip (10).

6. A golf club grip (10) according to claim 2, wherein said predetermined sinuous surface pattern (20) divides the at least front side (22) of the golf club grip (10) lengthwise essentially in half (28, 30).

7. A golf club grip (10) according to claim 1, wherein said plurality of arcs (32, 32') form at least a first pair of opposed arcs (34, 34'), a second pair of opposed arcs (36, 36'), and a third pair of opposed arcs (38, 38'), said second pair of opposed arcs (36, 36') being indicative of a first hand position (40), and said third pair of opposed arcs (38, 38') being indicative of a second hand position (42).

8. A golf club grip (10) according to claim 7, wherein said first hand position (40) comprises an inner edge of a thumb (44) positioned on the second arc (36) and an inner edge of an index finger (46) positioned on the opposed second arc (36').

9. A golf club grip (10) according to claim 7, wherein said second hand position (42) comprises an inner edge of a thumb (48) on the opposed third arc (38') and an inner edge of an index finger (50) on the third arc (38).

10. A method for hand placement on a golf club grip (10), comprising the steps of:

providing an elastomeric body (12) having a generally cylindrical shape with a bore (14) to be slidably received on a golf club shaft (16);

forming a predetermined sinuous surface pattern (20) on at least a front side (22) of said elastomeric body (12), said predetermined sinuous surface pattern (20) comprising a plurality of contiguous pairs of opposed arcs situated radially lengthwise along the golf club grip and extending from an upper portion (24) of said elastomeric body (12) to a lower portion (26) thereof; and indicating hand placement on said elastomeric body (12) with said predetermined sinuous surface pattern (20).

11. A method according to claim 10, wherein said forming step further comprises painting said predetermined sinuous surface pattern (20) on said elastomeric body (12).

12. A method according to claim 11, wherein said forming step further comprises the step of making a depression into said elastomeric body (12) of said predetermined sinuous surface pattern (20) prior to said painting step.

13. A method according to claim 12, further comprising the step of selectively orienting a second pair of opposed arcs (36, 36') of said plurality of opposed arcs (32, 32') on said elastomeric body (12) for a first hand position (40).

14. A method according to claim 13, further comprising the step of selectively orienting a third pair of opposed arcs (38, 38') of said plurality of opposed arcs (32, 32') on said elastomeric body (12) for a second hand position (42).

* * * * *